US007217173B1

(12) United States Patent
Yan et al.

(10) Patent No.: US 7,217,173 B1
(45) Date of Patent: May 15, 2007

(54) APPARATUS MICRO LAPPING WITH ABRASIVE FOR POLISHING PRECISION SCREW AND POLISHING METHOD THEREOF

(75) Inventors: Biing-Hwa Yan, Taoyuan County (TW); Hsinn-Jyh Tzeng, Taipei (TW); Jan-Ming Chen, Taoyuan County (TW); Sheng-Hsun Hsiao, Taipei County (TW)

(73) Assignee: National Central University, Taoyuan County (TW)

( * ) Notice: Subject to any disclaimer, the term of this patent is extended or adjusted under 35 U.S.C. 154(b) by 0 days.

(21) Appl. No.: 11/492,989

(22) Filed: Jul. 26, 2006

(30) Foreign Application Priority Data

Jul. 6, 2006 (TW) ..... 95124676 A

(51) Int. Cl.
*B24B 31/00* (2006.01)

(52) U.S. Cl. ..... 451/36; 451/104; 451/106

(58) Field of Classification Search ..... 451/35, 451/36, 41, 104–108, 120, 143; 15/21.1, 15/77, 88.2; 134/6, 7, 42, 25.1, 25.4
See application file for complete search history.

(56) References Cited

U.S. PATENT DOCUMENTS

| | | | | |
|---|---|---|---|---|
| 3,599,374 | A * | 8/1971 | Porter et al. | 451/113 |
| 5,486,134 | A * | 1/1996 | Jones et al. | 451/209 |
| 6,165,281 | A * | 12/2000 | Yoon | 134/8 |
| 6,406,356 | B1 * | 6/2002 | Brooks | 451/36 |
| 6,572,458 | B2 * | 6/2003 | Lim | 451/113 |
| 6,641,465 | B2 * | 11/2003 | Miyamoto | 451/104 |

* cited by examiner

*Primary Examiner*—Lee D. Wilson
*Assistant Examiner*—Anthony Ojini
(74) *Attorney, Agent, or Firm*—Trowell Law Office, PLLC

(57) ABSTRACT

The present invention is an apparatus for polishing a precision screw. The apparatus uses abrasive in a sealed container for polishing. Hence, the present invention can do precise polishing to obtain smooth surface of thread by removing tiny burrs with the abrasive.

14 Claims, 4 Drawing Sheets

APPARATUS MICRO LAPPING WITH ABRASIVE FOR POLISHING PRECISION SCREW AND POLISHING METHOD THEREOF

FIELD OF THE INVENTION

The present invention relates to polishing a precision screw; more particularly, relates to quickly removing burrs and bits with an abrasive on a surface of a screw for a fine polishing.

Description of the Related Art(s)

Researches related to micro-machines, precise screws, industries of aviation and space, vehicle transmissions and bio-medicines are popular and have become top hits nowadays. Take the applications in the military for example. The production and refinement for the precise screw rod in a barrel requires a good method for removing burrs precisely. Yet, until now, no satisfying solution is provided; not to mention the more complex refinement for an outer screwing thread.

A prior art is proclaimed in a Japanese patent, 2002 by Hitoshi Ohmori, etc., which discloses an abrasive chip of metal free, a polishing method using an electrolysis, and an apparatus for the polishing method. By using a connecting part between the abrasive and a carbon-containing non-metallic material containing the abrasive, a polishing of good efficiency is obtained with the help of the electrolysis. The prior art refines the roughness of the outer surface; yet, its applications to an inner or outer screwing thread or an irregular curved surface still has rooms left for improvement. In 2004, an other prior art is disclosed by V. K. Gorana, etc. in International Journal of Machine Tool & Manufacture, Vol. 44, pp. 201–211, which discusses the effect of the extrusion pressure, the abrasive density and the size of the particle to the material removing amount, the surface roughness, the cutting force and the density of the actuated particles by polishing with a flowing abrasive. Parameters for the polishing discussed includes: particle size, abrasive type, abrasive concentration, polishing time, and the material of the to-be-polished object. The polishing method for the prior art is to remove material and to refine surface by a reciprocating motion with pressure to the to-be-polished object, where its application is especially focused on precise transmission device. And, the disadvantage still remains that applications to an outer screwing thread or an irregular curved surface still has rooms left for improvement. A third prior art is disclosed in 2004 by V. K. Jain, etc. in the International Journal of Machine Tool & Manufacture, Vol. 44, pp. 1019–1029, which designs a polishing method having a combination of a polishing with particles and a fine polishing with an electromagnetic flow. A research on the surface roughness and the removal amount of the material after using the method with various abrasives is studied. Furthermore, a method for polishing with rotating particles driven by rotating magnetic poles is developed; and a research on the shapes of the magnetic poles and their rotating velocities are studied with regard to the surface roughness and the removal amount of the material after the polishing. Likewise, the disadvantage remains that applications to an outer screwing thread or an irregular curved surface still has rooms left for improvement on material removing and surface refining.

In a word, although the above prior arts can improve the surface fineness of the to-be-polished object, the disadvantage regarding removing burrs, pieces and deteriorated exterior in an outer tiny screw slot or on an irregular surface is still left unsolved. Hence, the prior arts do not fulfill users' requests on actual use.

SUMMARY OF THE INVENTION

The main purpose of the present invention is to remove burrs and bits on a work-piece for a fine polishing.

The second purpose of the present invention is to load abrasive in a sealed main body to reduce the dust or the ashes after the polishing.

The third purpose of the invention is to obtain a simple structure for mass production, which is easy to be assembled and dissembled and to be filled with abrasive.

To achieve the above purposes, the present invention is an apparatus lapping with an abrasive for polishing a precision screw and a polishing method thereof. The apparatus lapping with an abrasive for polishing a precision screw comprises a spindle clamp, a rotating rod, a main body, a fixed sleeve, a support bracket and a blender device.

The apparatus has a polishing method comprising steps of: putting a work-piece into the main body to be fixed by the rotating rod and filling the main body with an abrasive; fixing the apparatus on a machining table; setting up parameters for polishing; activating the machining table to rotate the spindle clamp by a rotating shaft of the machining table to further rotate the rotating rod carrying the work-piece with the abrasive polishing the work-piece by flowing through the fixed sleeve circularly following a rotating of the work-piece and a blending of the blender device; and terminating the machining table and taking out the work-piece when finishing polishing.

Accordingly, a novel apparatus lapping with an abrasive for polishing a precision screw and a polishing method thereof are obtained.

BRIEF DESCRIPTIONS OF THE DRAWINGS

The present invention will be better understood from the following detailed description of the preferred embodiment according to the present invention, taken in con junction with the accompanying drawings, in which FIG. 1 is the sectional view of the preferred embodiment according to the present invention;

DESCRIPTION OF THE PREFERRED EMBODIMENT

The following description of the preferred embodiment is provided to understand the features and the structures of the present invention.

Figure 1:
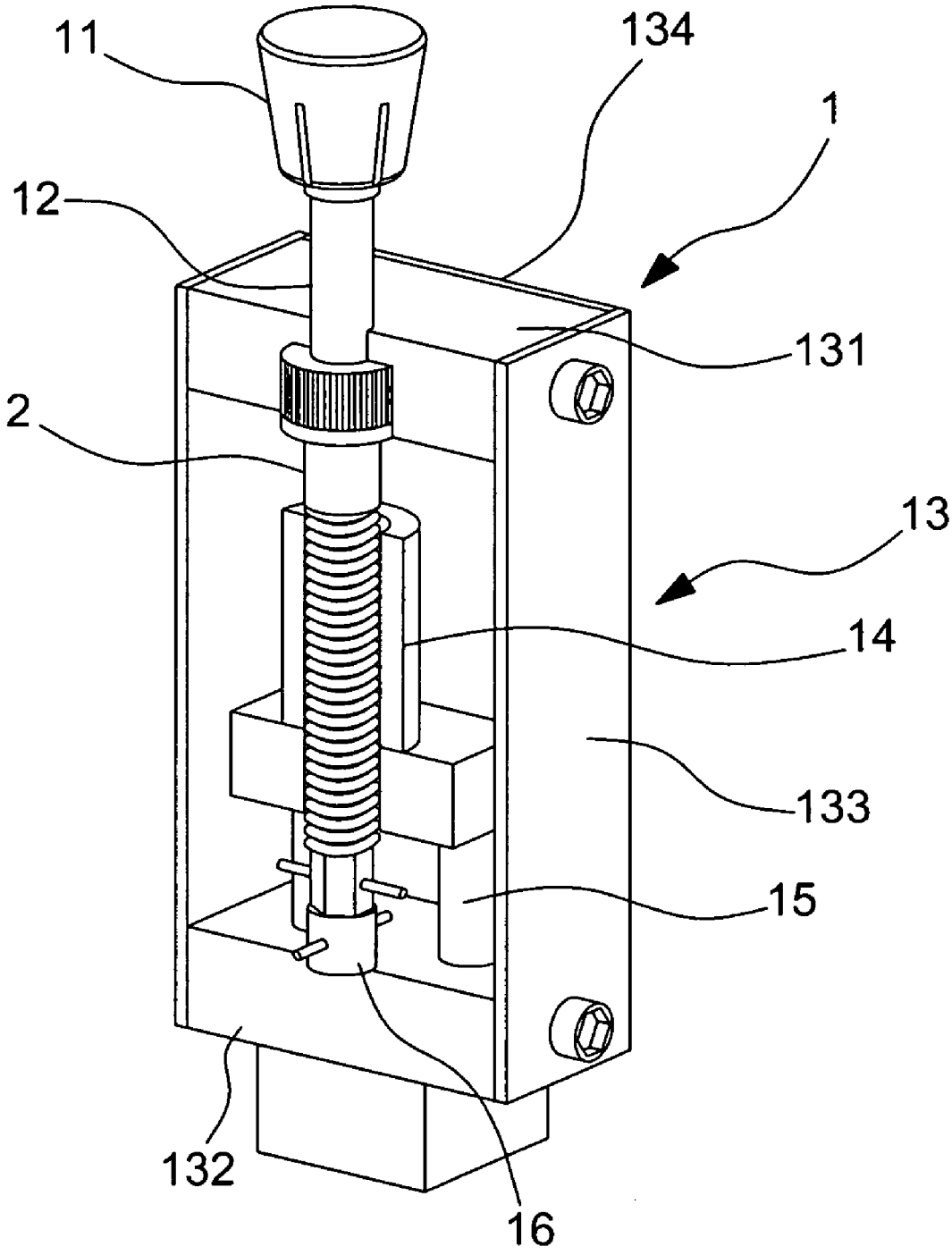

Please refer to FIG. 1, which is a sectional view of a preferred embodiment according to the present invention. As shown in the figure, the present invention is an apparatus lapping with an abrasive for polishing a precision screw and a polishing method thereof. The apparatus lapping with an abrasive for polishing a precision screw 1 comprises a spindle clamp 11, a rotating rod 12, a main body 13, a fixed sleeve 14, a support bracket 15 and a blender device 16.

The spindle clamp 11 is fixed to a rotating shaft of a machining table (not shown in the figure).

The rotating rod 12 is positioned with a work-piece 2 and is locked with the spindle clamp 11, where the work-piece 2 is penetrated through a top cover 131 of the main body 13 and the fixed sleeve 14 and the work-piece 2 is butted against the blender device 16 for better stability and efficiency of polishing. The work-piece 2 is assembled with the top cover 131, the fixed sleeve 14 and the blender device 16 with a bearing or a rotary sleeve, where the bearing can be a ball bearing.

The main body 13 comprises the top cover 131, a bottom seat 132, two side covers 133 and two side panels 134, where the two side covers 133 and the two side panels 134 are locked to the top cover 131 and the bottom seat 132 by using a position pin, a fixing bolt and/or a hasp. The top cover 131, the bottom seat 132 and the side covers 133 are made of a metal of iron; and the side panels 134 are made of a metal or a non-metal. The main body 13 is loaded with an abrasive. The abrasive is obtained from an engine oil or a lubricating oil mixed with hard particles of SiC or other particles of a various size; or a silicon oil, a wax oil or a polymer gel solution mixed with particles of SiC or other particles of a various size. And the main body 13 is further equipped with a temperature measuring device.

The fixed sleeve 14 is located in the main body 13 with a support bracket 15 at bottom to be fixed on the bottom seat 132; and an inner diameter and a shape of the fixed sleeve 14 is modified according to the work-piece 2.

The blender device 16 has a plurality of blending blades or blending rods; and is set below center of the fixed sleeve 14 and the support bracket 15 above the bottom seat 132. The work-piece 2 is set at a rotary top pin of the blender device; is penetrated through the fixed sleeve 14 and the support bracket 15; and is positioned with the rotating rod 12 to be assembled with the fixed sleeve 14 and the support bracket 15 to be fixed on the bottom seat 132; and a size, a shape and an arrangement of the blender device 16 is modified according to the work-piece 2, where the flowing of the abrasive is smoothened with the help of the blender device 16. Thus, a novel apparatus lapping with an abrasive for polishing a precision screw 1 is obtained.

Figure 2:
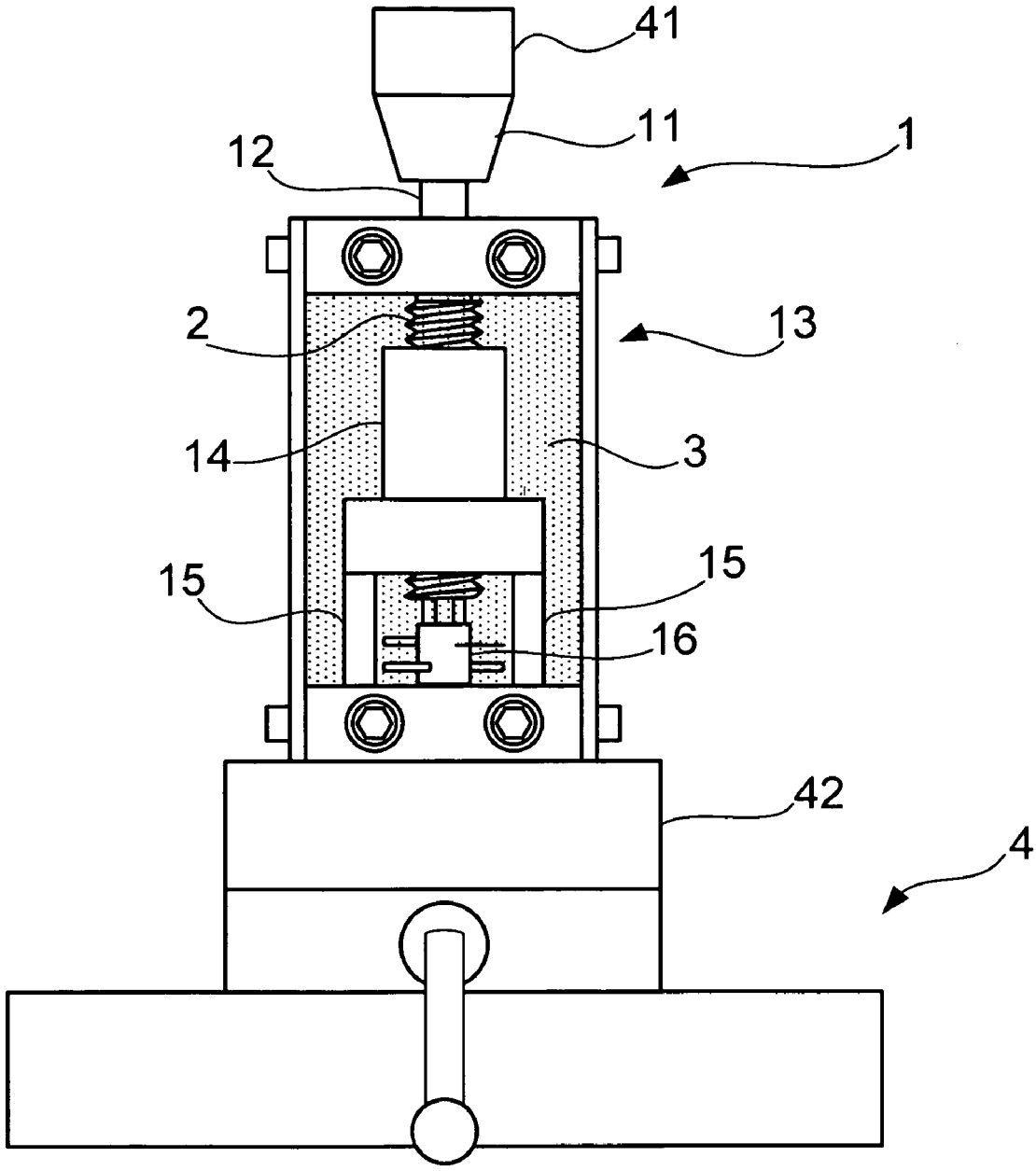
FIG. 2 is the lateral sectional view of the preferred embodiment.
Figure 3:
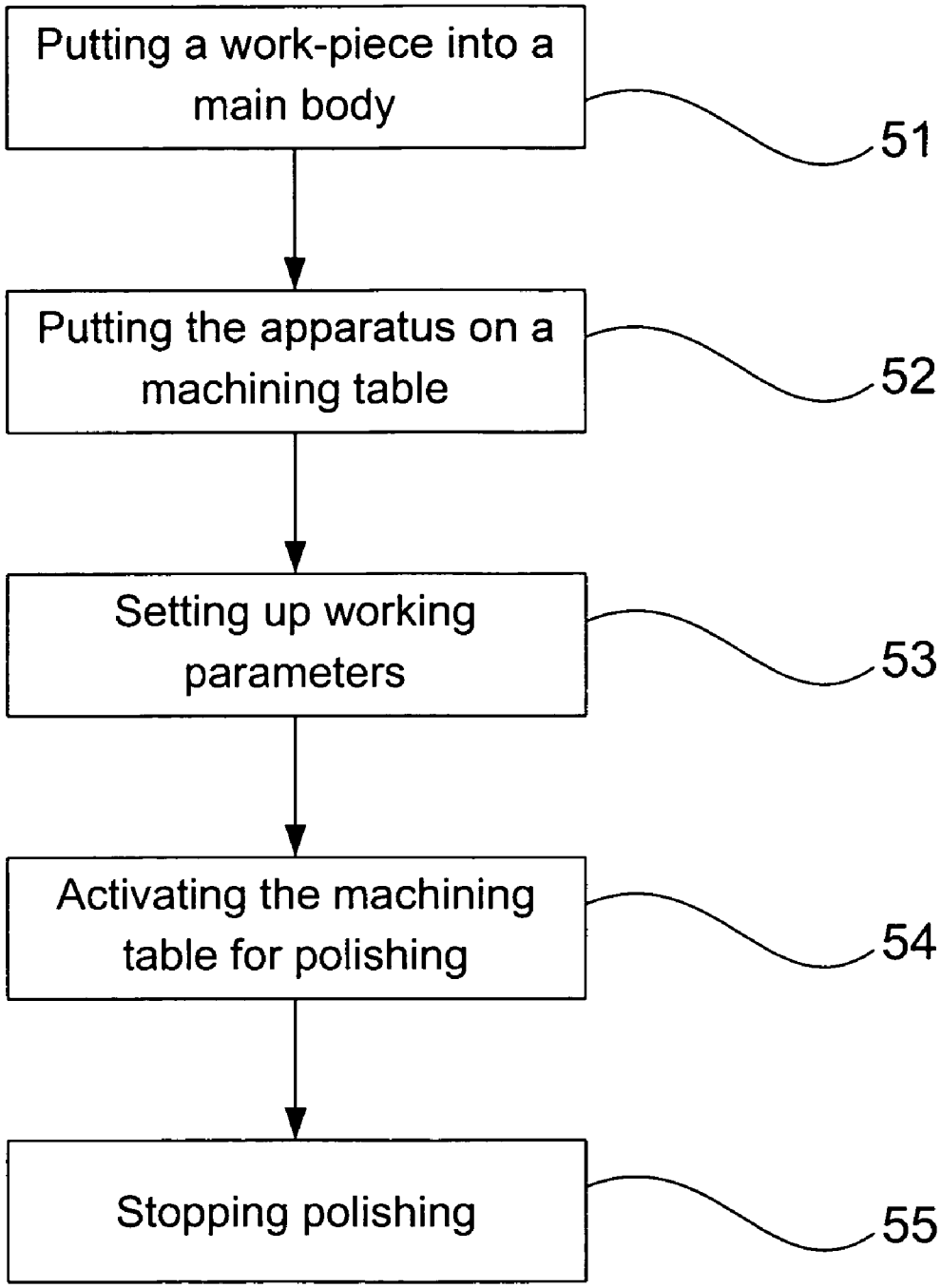
FIG. 3 is the view showing the flow chart of the polishing.
Figure 4:
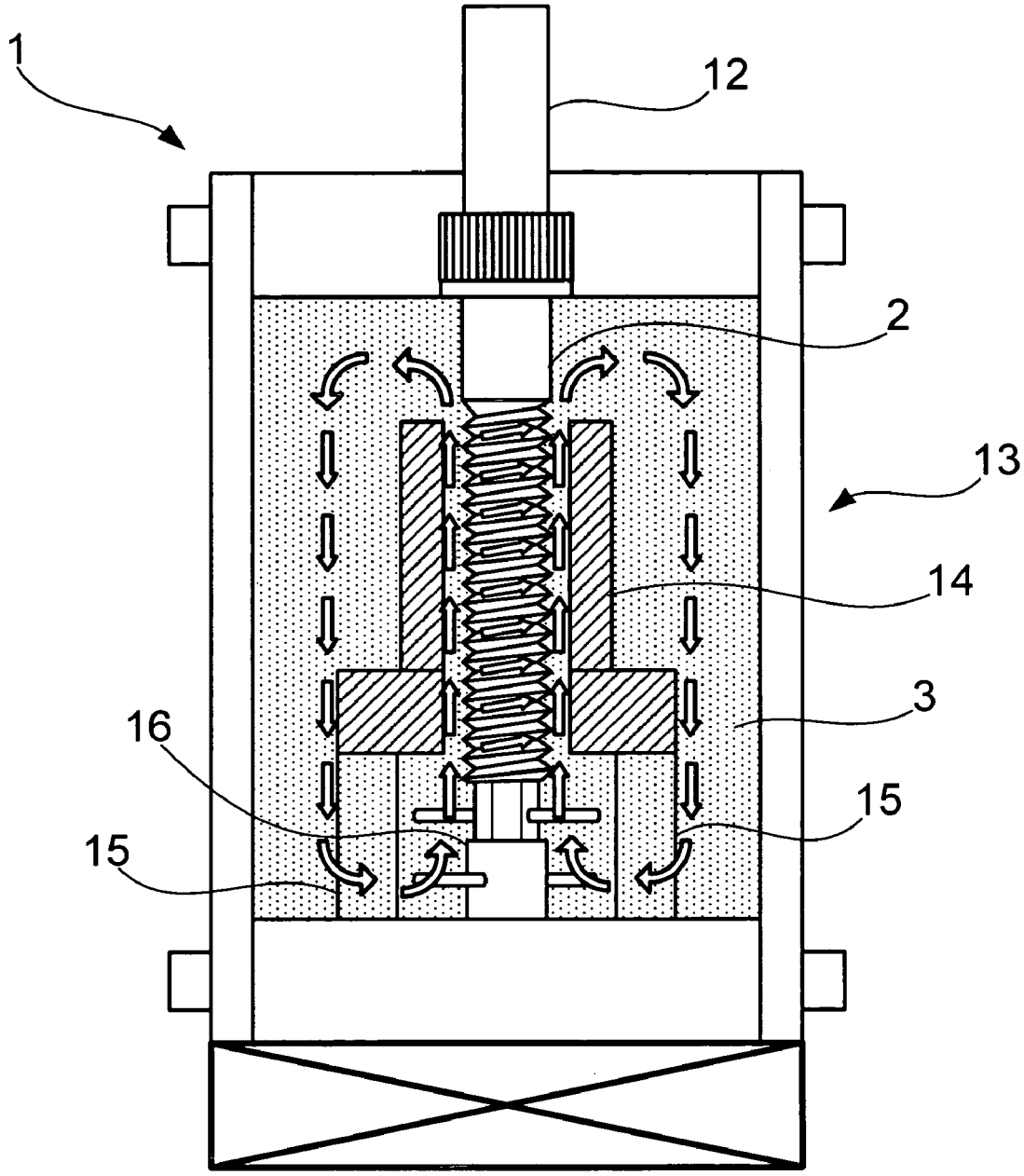
FIG. 4 is the view showing the state of use.

Please refer to FIG. 2, FIG. 3 and FIG. 4, which are a lateral sectional view of the preferred embodiment; a view showing a flow chart of a polishing; and a view showing a state of use. As shown in the figures, the apparatus lapping with an abrasive for polishing a precision screw 1 has a polishing method comprising the following steps:

(a) Putting a work-piece into a main body 51: A work-piece 2 penetrating through a fixed sleeve 14 and a support bracket 15 is put between a rotating rod 12 and a blender device 16, where the work-piece 2 is fixed by the rotating rod 2; and a main body 13 is filled with an abrasive 3.

(b) Putting the apparatus on a machining table 52: A spindle clamp 11 of the apparatus 1 is fixed to a rotating shaft 41 of a machining table 4 at the upper end; and the lower end of the apparatus 1 is fixed to a holder device 42 of the machining table 4.

(c) Setting up working parameters 53: Parameters are setup, which includes an abrasive diameter, an abrasive density, a working gap, an inner diameter of the fixed sleeve 14, a type of the fixed sleeve 14, a type of the blender device 16 and a rotating velocity of the blender device 16.

(d) Activating the machining table for polishing 54: The machining table is activated to drive the spindle clamp 11 by the rotating shaft 41 of the machining table 4 so that the rotating rod 12 rotates the work-piece 2 to bring the abrasive 3 to polish the work-piece. The abrasive 3 follows a rotating of the work-piece 2 and a blending of the blender device 16 to be flown circularly in the fixed sleeve 14 and the support bracket 15. A machining gap between the inner diameter of the fixed sleeve 14 and the outer diameter of the work-piece 2 is formed for polishing the work-piece 2.

(e) Stopping polishing 55: The machining table 4 is stopped and the work-piece 2 is taken out.

In step (d), when the abrasive is not flown in the fixed sleeve 14 and the support bracket 15, the abrasive has a good coherence. When the abrasive start to be flown in the fixed sleeve 14 and the support bracket 15 following a rotating of the work-piece and a blending of the blender device 16, the viscosity of the abrasive is reduced following changes of the working criteria and the passing of time. A polishing liquid is thus formed.

The present invention, by the rotation of the work-pieces 2 cooperated with the blender device 16 and the working gap formed between the outer diameter of the work-piece 2 and the inner diameter of the fixed sleeve, transfers the abrasive 3 to press on the work-piece 2 for tiny polishing on the surface so that burrs, pieces and a deteriorated exterior is fast removed.

To sum up, the present invention is an apparatus lapping with an abrasive for polishing a precision screw and a polishing method thereof, where thread surface of a screw of a work-piece is fine-polished; an abrasive is loaded in a main body to reduce dusts and ashes; and the assembly and disassembly is simple for mass production.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. An apparatus micro lapping with an abrasive for polishing a precision screw, comprising a spindle clamp, said spindle clamp fixing to a rotating shaft of a machining table;

a rotating rod, said rotating rod being locked to said spindle clamp;

a main body, said main body comprising a top cover, a bottom seat, two side covers and two side panels, said main body containing an abrasive;

a fixed sleeve, said fixed sleeve being located in said main body;

a support bracket, said support bracket being deposed on said bottom seat, said support bracket supporting said fixed sleeve; and a blender device, said blender device being located between said bottom seat and said support bracket.

2. The apparatus according to claim 1, wherein said machining table is a miller selected from a group consisting of a general miller and a computer numerical control (CNC) miller.

3. The apparatus according to claim 1, wherein said side cover and said side panel is locked to said top cover and said bottom seat by using a plurality of members selected from a group consisting of a position pin, a fixing bolt and a hasp.

4. The apparatus according to claim 1, wherein said top cover, said bottom seat and said side cover are made of metal.

5. The apparatus according to claim 4, wherein said metal is iron.

6. The apparatus according to claim 1, wherein said abrasive is an oil mixed with particles;

wherein said oil is an engine oil, a lubricating oil, a silicon oil, a wax oil and a polymer gel solution; and wherein said particles are particles of SiC.

7. The apparatus according to claim 1, wherein said main body further comprises a temperature measuring device.

8. The apparatus according to claim 1, wherein an inner diameter and a shape of said fixed sleeve is modified according to a work-piece.

9. The apparatus according to claim 1, wherein said blender device has a plurality of members selected from a group consisting of a plurality of blending blades and a plurality of blending rods.

10. The apparatus according to claim 1, wherein an inner diameter, a shape and an inner diameter, a shape and an arrangement of said fixed sleeve is modified according to a work-piece.

11. The apparatus according to claim 1, wherein said apparatus has a method comprising steps of:

(a) locating a work-piece into said fixed sleeve and said support bracket and filling an abrasive in said main body, said work-piece locating between said rotating rod and said blender device, said work-piece being fixed with said rotating rod, said work-piece being butted against said blender device;

b) fixing said rotating shaft of said machining table with said spindle clamp at an end of said apparatus and fixing a holder device of said machining table at the other end of said apparatus;

(c) setting up working parameters;

(d) activating said machining table to rotate said spindle clamp by said rotating shaft to further rotate said rotating rod carrying said work-piece with said abrasive, said abrasive flowing in said fixed sleeve circularly to polishing said work-piece following said rotating of said work-piece and a blending of said blender device; and (e) terminating said machining table and taking out said work-piece.

12. The apparatus according to claim 11, wherein said work-piece is assembled with said top cover, said fixed sleeve and said blender device with a member selected from a group consisting of a bearing and a rotary sleeve.

13. The apparatus according to claim 12, wherein said bearing is a ball bearing.

14. The apparatus according to claim 11, wherein said working parameters comprise an abrasive diameter, an abrasive density, a working gap, an inner diameter of said fixed sleeve, a type of said fixed sleeve, a type of said blender device and a rotating velocity of said blender device.

* * * * *